US008985068B2

(12) United States Patent
Nicgorski

(10) Patent No.: US 8,985,068 B2
(45) Date of Patent: Mar. 24, 2015

(54) SYSTEMS AND METHODS FOR AVOIDING RESONANCES EXCITED BY ROTATING COMPONENTS

(75) Inventor: Dana Nicgorski, Salem, MA (US)

(73) Assignee: Robert Bosch GmbH, Stuttgart (DE)

( * ) Notice: Subject to any disclaimer, the term of this patent is extended or adjusted under 35 U.S.C. 154(b) by 202 days.

(21) Appl. No.: 12/841,660

(22) Filed: Jul. 22, 2010

(65) Prior Publication Data

US 2012/0017856 A1 Jan. 26, 2012

(51) Int. Cl.
*F01P 7/04* (2006.01)

(52) U.S. Cl.
CPC ..... *F01P 7/048* (2013.01)
USPC ..... 123/41.49; 416/1; 416/37; 324/166

(58) Field of Classification Search
CPC ..... F01P 7/02; F01P 7/04; F04D 27/00; F04D 29/66; H02P 7/00
USPC ..... 123/41.11, 41.12, 41.49; 416/1, 37; 324/166
See application file for complete search history.

(56) References Cited

U.S. PATENT DOCUMENTS

| | | | | |
|---|---|---|---|---|
| 4,608,650 | A * | 8/1986 | Kapadia | 700/279 |
| 5,099,430 | A | 3/1992 | Hirsch | |
| 5,314,308 | A | 5/1994 | Reed, III | |
| 5,370,340 | A * | 12/1994 | Pla | 244/1 N |
| 5,423,658 | A | 6/1995 | Pla et al. | |
| 5,515,444 | A * | 5/1996 | Burdisso et al. | 381/71.5 |
| 5,627,762 | A | 5/1997 | Cameron et al. | |
| 6,010,303 | A * | 1/2000 | Feulner | 415/118 |
| 6,192,839 | B1 * | 2/2001 | Takeshita et al. | 123/41.49 |
| 6,195,982 | B1 * | 3/2001 | Gysling et al. | 60/204 |
| 7,303,140 | B2 | 12/2007 | Jones et al. | |
| 7,347,167 | B2 * | 3/2008 | Sugiyama et al. | 123/41.11 |
| 7,424,396 | B2 * | 9/2008 | Dodeja et al. | 702/185 |
| 7,481,116 | B1 | 1/2009 | Osborn | |
| 7,496,435 | B2 * | 2/2009 | Iwatsuki et al. | 701/22 |
| 7,565,226 | B1 | 7/2009 | Cooley et al. | |
| 7,920,973 | B2 * | 4/2011 | Mollmann et al. | 702/56 |
| 7,921,816 | B2 * | 4/2011 | Okuda et al. | 123/41.12 |

(Continued)

FOREIGN PATENT DOCUMENTS

| | | |
|---|---|---|
| CN | 101876320 | 11/2010 |
| DE | 19938319 | 2/2001 |

(Continued)

OTHER PUBLICATIONS

Ian R. Sinclair, Sensors and Transducers, (3d ed. 2001), Online version avalible at: http://app.knovel.com/hotlink/toc/id:kpSTE0001U/sensors-transducers-3rd/sensors-transducers-3rd, 1 pertinent page, p. xi provided.*

(Continued)

*Primary Examiner* — Noah Kamen
*Assistant Examiner* — Grant Moubry
(74) *Attorney, Agent, or Firm* — Michael Best & Friedrich LLP

(57) ABSTRACT

A system for operating a rotating component. The system includes a rotating component, a motor driving the rotating component, a sensor detecting a stimulus related to the rotating component, and a controller. The controller receives an indication of the magnitude of the stimulus from the sensor and is configured to adjust a speed of the rotating component when the stimulus indicates the rotating component is operating at a resonant frequency.

13 Claims, 5 Drawing Sheets

(56) References Cited

U.S. PATENT DOCUMENTS

| | | | | |
|---|---|---|---|---|
| 8,485,309 | B2 * | 7/2013 | Busse et al. | 181/206 |
| 8,532,828 | B2 * | 9/2013 | Schramm et al. | 700/280 |
| 2006/0191500 | A1 * | 8/2006 | Sugiyama et al. | 123/41.12 |
| 2009/0013790 | A1 | 1/2009 | Roders | |
| 2009/0015241 | A1 * | 1/2009 | Gross et al. | 324/166 |
| 2009/0145376 | A1 | 6/2009 | Okuda et al. | |
| 2010/0080399 | A1 | 4/2010 | Pfau et al. | |
| 2010/0191416 | A1 * | 7/2010 | Yamaguchi et al. | 701/36 |
| 2011/0040445 | A1 * | 2/2011 | Mougey et al. | 701/36 |

FOREIGN PATENT DOCUMENTS

| | | |
|---|---|---|
| DE | 102008001024 | 10/2009 |
| JP | 61227698 | 10/1986 |
| JP | 6257592 | 9/1994 |
| JP | 11107753 | 4/1999 |
| JP | 2001193460 | 7/2001 |
| JP | 2004044507 | 2/2004 |
| JP | 2004095130 | 3/2004 |
| WO | 2009124842 | 10/2009 |

OTHER PUBLICATIONS

Kakuda, Y.; Maeda, S.; Matsuyama, T.; and Saito, F., "Noise reduction of flat motor for propeller fans" abstract, Apr. 1991, vol. 37, n. 2, National Technical Report, Japan.

Duffield, C. J., "Experimental Investigation on Periodic Forced Vibrations of a Bladed Disk" abstract, Mar. 2000, Air Force Inst. of Tech., Wright-Patterson AFB, OH, School of Engineering.

Lo, W. C.; Chan, C. C.; Zhu, Z. Q.; Xu, Lie; Howe, D; and Chau, K. T., "Acoustic noise radiated by PWM-controlled induction machine drives" abstract, Aug. 2000, vol. 47, n. 4, IEEE Transactions on Industrial Electronics, USA.

PCT/US2011/044087 International Search Report and Written Opinion dated Nov. 3, 2011, 15 pages.

Chinese Patent Office Action for Application No. 201180039865.3 dated Sep. 28, 2014 (24 pages—Including English Translation).

"Practice in Determining Resonance Characteristics of Rotor System using Bode Plot," China Academic Journal Publishing House, 1992 (10 pages—Including English Translation).

* cited by examiner

SYSTEMS AND METHODS FOR AVOIDING RESONANCES EXCITED BY ROTATING COMPONENTS

BACKGROUND

Rotating components can excite the structural resonances of themselves or of nearby components due to an excitation force at some multiple of the rotation speed. These resonances cause unwanted vibration and noise resulting in discomfort for individuals nearby as well as reducing the durability and performance of the affected components.

Therefore, systems are characterized so the speeds that excite resonances are avoided. Avoiding resonance reduces noise and vibration and resulting machinery damage. However, because of manufacturing variances, the use of temperature-sensitive plastics in temperature-varying environments, or a lack of knowledge of what the rotating-component ultimately attaches to, the resonances of many systems cannot be fully characterized, and a preemptive approach to avoiding resonances cannot be achieved.

SUMMARY

Many engine cooling fans are manufactured using plastics which have material properties that change with humidity and/or temperature changes. Thus, characterizing the resonances of these fans at a fixed temperature and humidity level results in a system characterization that is different than the actual system when the fans are exposed to different environmental conditions.

Engine cooling fan resonances can shift in frequency and acoustic significance as temperature, plastic moisture content, manufacturing variance, and/or automobile dynamic characteristics change. Resonances may be excited by imbalance forces, cogging torque, electromagnetic forces, commutation phenomena, and aerodynamic blade forces. When an engine cooling fan operates at resonance; vibration, noise, and wear increase often resulting in customer complaints and product redesigns.

The fan can only be designed to be structurally quiet under a very specific set of environmental conditions. Because of changing properties of the fan, the fan will often perform better or worse than the design target based on the stiffness and damping of the plastic under actual operating conditions. Accordingly, what is needed are methods of continuously determining and avoiding the resonant speeds of a rotating component to avoid resonances under normal operation and improve the noise, vibration and/or durability performance of the component.

The present invention relates to systems and methods of continuously determining and avoiding resonant frequencies excited by a rotating component in a situation (for example, the component's environment, e.g., temperature, humidity, etc., and relationships with other components, e.g., radiators, automobile chassis, etc.).

In one embodiment, the invention provides a system for operating a rotating component. The system includes a rotating component, a motor driving the rotating component, a sensor detecting a stimulus related to the rotating component, and a controller including a memory. The controller stores a representation of a magnitude of the stimulus for a plurality of operating speeds of the rotating component, and receives an indication of the magnitude of the stimulus from the sensor. The controller determines which operating speeds represent resonant frequencies based on the stored magnitudes, and adjusts a speed of the rotating component when the controller determines the rotating component is operating at a resonant frequency.

In another embodiment, the invention provides a method of operating a rotating component. The method includes rotating the rotating component, detecting a stimulus, the stimulus related to at least one of noise and vibration, determining an operating condition of the rotating component, recording a magnitude of the stimulus and the operating condition of the rotating component, determining the operating condition of the rotating component is exciting a resonance, and adjusting the operating condition of the rotating component to avoid the resonance.

In another embodiment, the invention provides a vehicle including an engine cooling fan. The vehicle includes a control module, an engine cooling fan, a motor driving the engine cooling fan, a sensor detecting a stimulus related to the engine cooling fan, and a motor controller coupled to the control module. The motor controller controls the motor to rotate the engine cooling fan based on an indication from the control module. The motor controller also receives an indication of the magnitude of the stimulus from the sensor and adjusts a speed of the engine cooling fan when the stimulus indicates the engine cooling fan is operating at a resonant frequency.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
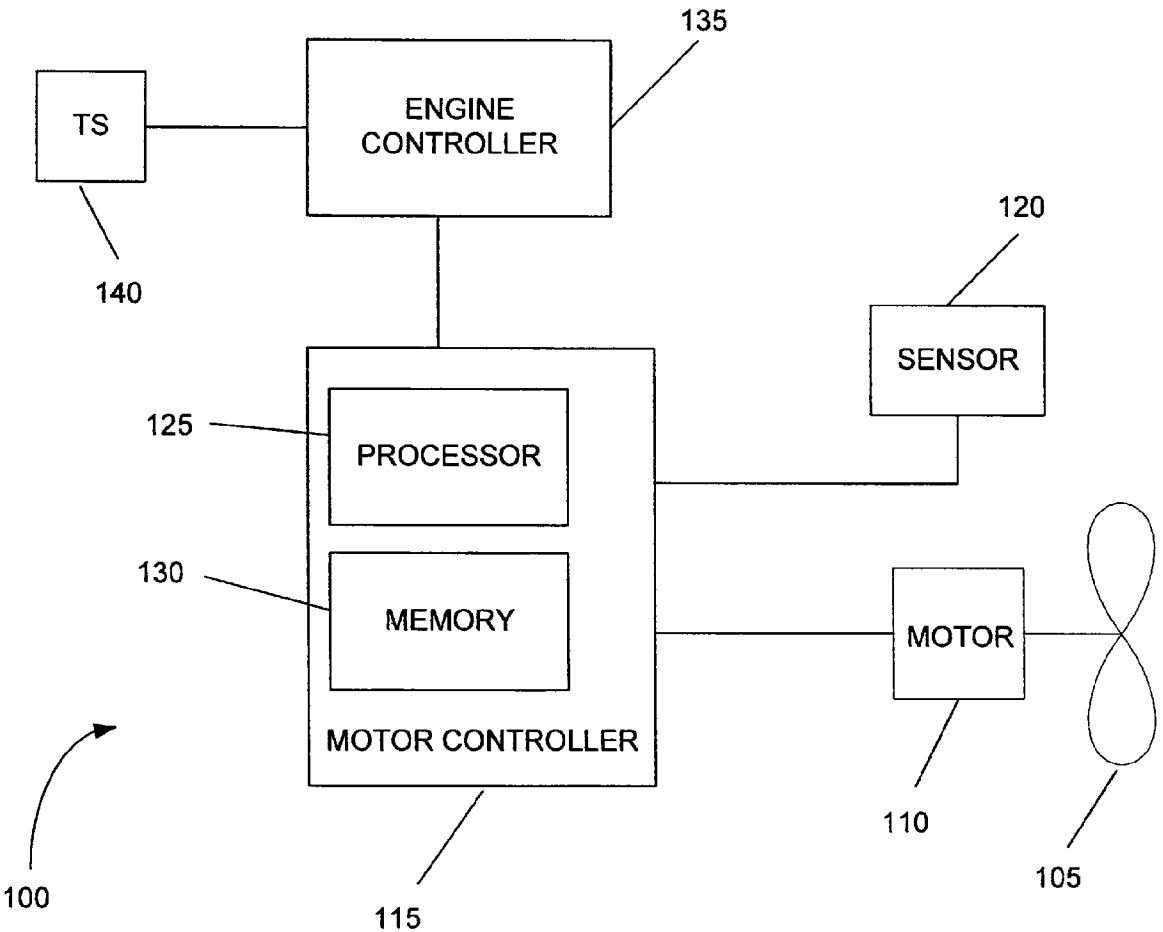
FIG. 1 is a block diagram of an embodiment of a system for avoiding operating a rotating component at a resonant frequency.

FIG. 1 shows an embodiment of a system 100 for operating a rotating component 105 (e.g., an engine cooling fan). The system 100 determines whether the rotating component 105 is operating at a resonant frequency, and adjusts a speed of the rotating component 105 when the rotating component 105 is operating at a resonant frequency or at a speed that is resonant with other components. In the embodiment shown, the system 100 includes an engine cooling fan 105 driven by a motor 110, a motor controller 115, and a sensor 120. The sensor 120 is a sensor capable of detecting resonances such as a vibration sensor (e.g., an accelerometer), a pressure sensor (e.g., a sound pressure sensor such as a MEMS microphone), or a strain/displacement sensor. The motor controller 115 includes a processor 125 (e.g., a microprocessor, microcontroller, ASIC, DSP, etc.) and memory 130 (e.g., flash, ROM, RAM, EEPROM, etc.), which can be internal to the processor 125, external to the processor 125, or a combination thereof. The motor controller 115 also includes other circuits such as input/output circuits and communication circuits.

In the embodiment shown, an engine controller 135 receives an indication of engine temperature from a temperature sensor 140. The engine controller 135 provides a signal to the motor controller 115 indicating that engine cooling is required (e.g., the temperature of the engine exceeds a threshold, an air conditioning system is turned on adding additional load to the engine, etc.). In some embodiments, the motor controller 115 is coupled directly to the temperature sensor 140 and operates the cooling fan 105 based on a signal received from the temperature sensor 140. In some embodiments, the signal from the engine controller 135 indicates an operating speed for operating the engine fan 105. The motor controller 115 ramps the motor 110 to an operating speed (e.g., from zero to the operating speed), rotating the engine cooling fan 105 and cooling the engine. The sensor 120 continuously detects a stimulus (e.g., vibration or pressure) and provides a signal indicative of the magnitude of the detected stimulus to the motor controller 115. The motor controller 115 records the detected stimulus and the corresponding speed (e.g., rotations per minute) of the motor 110/fan 105 in the memory 130. Using the recorded data, the motor controller 115 determines if the operating speed coincides with a resonant frequency of the fan 105. If the operating speed coincides with a resonant frequency of the fan 105, the motor controller 115 adjusts the operating speed faster or slower so that the fan 105 is operating at a speed that does not coincide with a resonant frequency of the fan 105, reducing noise, vibration, and wear of the fan 105 and other components (e.g., a radiator, etc.).

In some embodiments, the speed of the motor 110 is not known, e.g., for a brushed DC motor operating under pulse width modulation (PWM) control. In an embodiment using PWM control of the motor 110, filters are used to obtain relationships between the PWM duty cycle and response amplitudes for different critical frequency bands. The critical frequency bands can be weighted to account for human perception (e.g., providing more weight to a frequency band in a human auditory range). Thus, critical frequency bands that do not offend humans can have a reduced level of correction for resonance, still taking into account the effects on wear and performance of the component.

Figure 2:
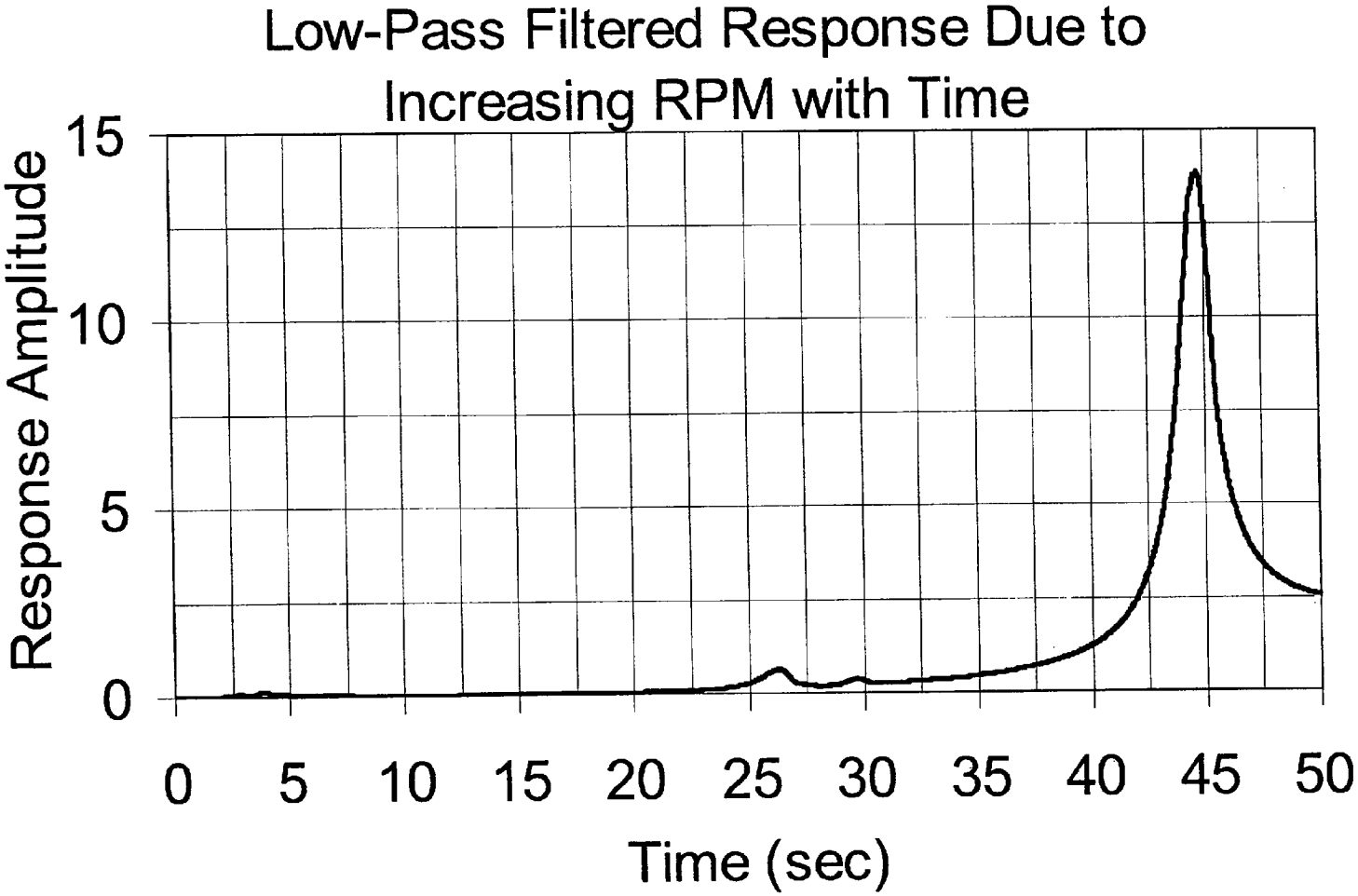
FIG. 2 is a graph showing a low-pass filtered magnitude of a measured stimulus caused by a rotating component as the speed of the rotating component is increased with time.

In one embodiment, imbalance forces (i.e., a first order excitation) on a fan 105 occur at low frequencies. The motor controller 115 detects a set of response amplitudes of the sensor 120 using a low pass or band pass filter having a cut-off frequency slightly higher than the maximum operating RPM of the fan 105. Tracking the response amplitudes versus the PWM duty cycle identifies the duty cycles for which resonance occurs. For example, FIG. 2 shows a graph of a low-pass filtered signal from a sensor 120 over time (e.g., while ramping the fan up to maximum speed). As can be seen in the graph, a resonance occurred at approximately 45 seconds. The duty cycle of the PWM signal controlling the motor 110 at that point in time is a duty cycle which causes resonance in the system. Therefore, when the fan 105 is being operated at a low speed, the identified duty cycles can be avoided by altering the fan speed, i.e., increasing or decreasing the duty cycle.

Figure 3:
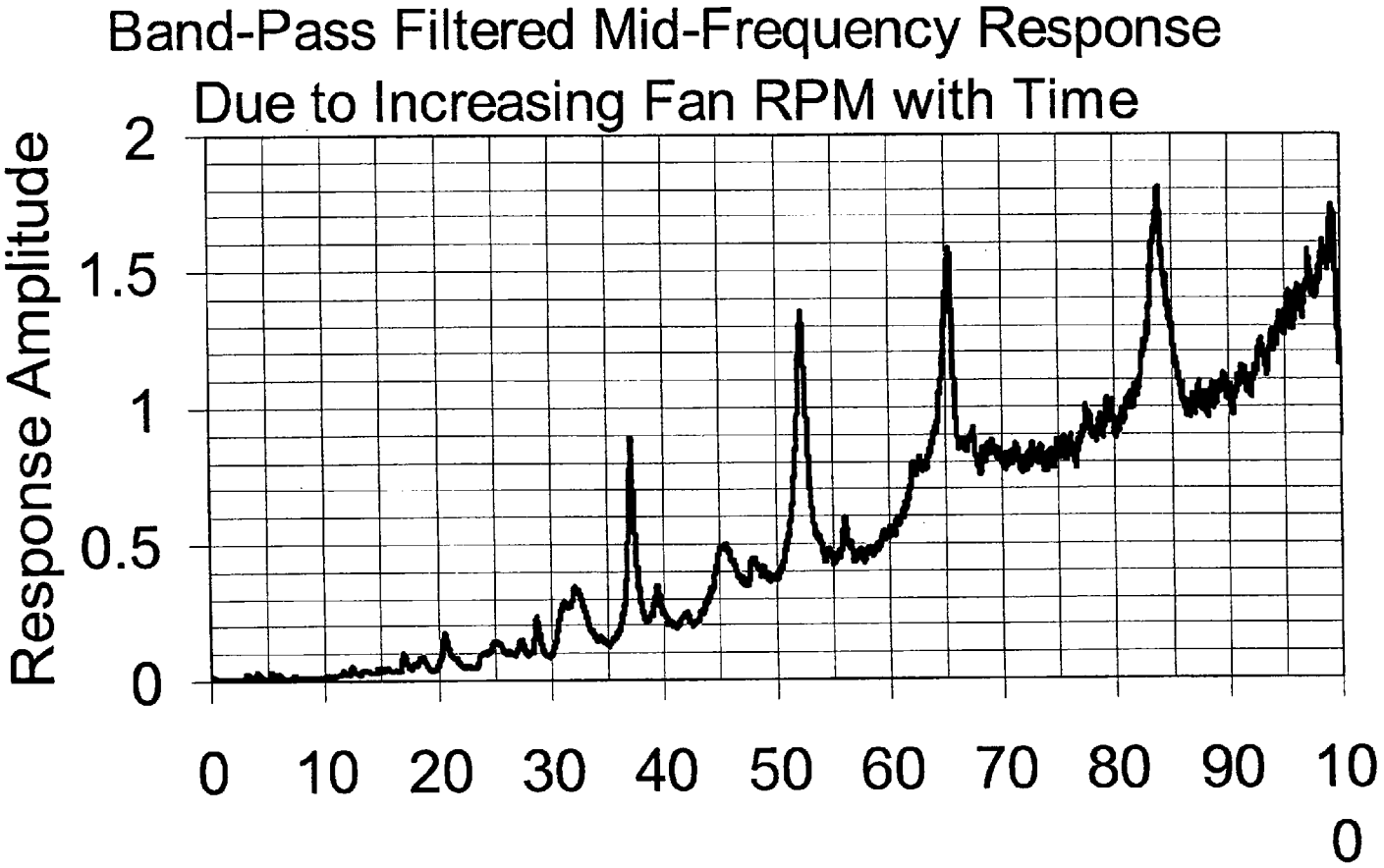
FIG. 3 is a graph showing a mid-frequency band-pass filtered magnitude of a measured stimulus caused by a rotating component as the speed of the rotating component is increased with time.

One or more noise sources can often exist due to resonances of the fan 105 excited by the motor 110. Often these noise sources fall in a range of 250 to 700 Hz. FIG. 3 shows a band-pass filter used to identify resonances in this range. Again, when resonances are identified, a corresponding PWM duty cycle can be avoided.

Figure 4:
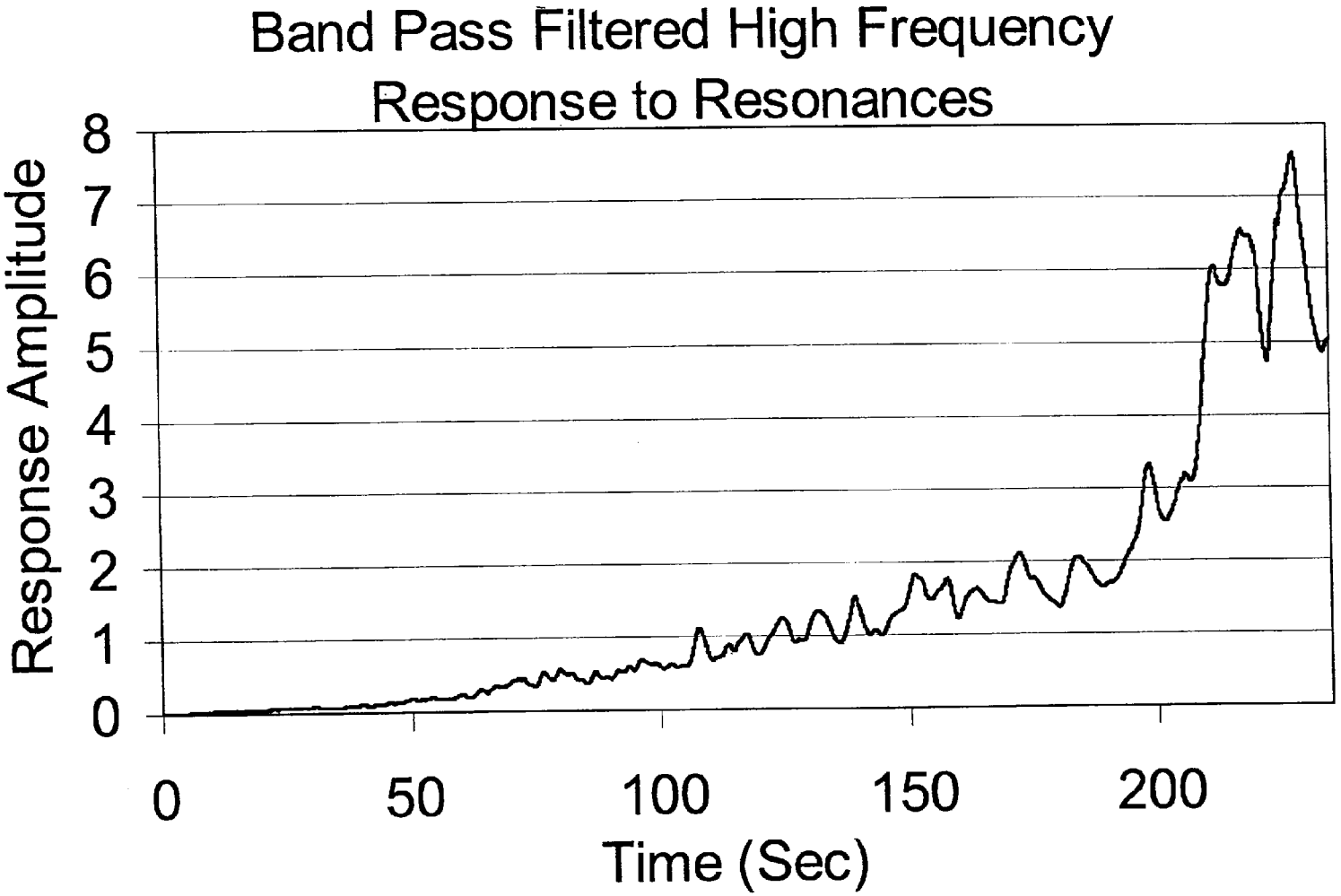
FIG. 4 is a graph showing a high-frequency band-pass filtered magnitude of a measured stimulus caused by a rotating component as the speed of the rotating component is increased with time.

Higher frequency noise sources can occur due to internal motor resonances. Again, a band-pass filter is used to identify resonances in this range. For example, FIG. 4 shows a graph of a 1000-1500 Hz band-pass filtered signal from a sensor 120 over time (e.g., while ramping the fan) to capture internal motor resonances. As can be seen in the graph, a pair of resonances occurred at approximately 220 and 240 seconds. The duty cycles of the PWM signal controlling the motor 110 at those points in time were duty cycles which caused resonance in the system. Therefore, when the fan 105 is being operated at a high speed, the identified duty cycles can be avoided by altering the fan speed, again by increasing or decreasing the duty cycle.

In embodiments where the speed of the fan 105 is known (e.g., electronically commutated motors), or when the signal processing capabilities of the motor controller can determine fan speed from the sensor 120 (e.g., using a model-based filter, Kalman filter, etc.), the actual speed of the motor 110 is adjusted to avoid resonances instead of adjusting a duty cycle of a PWM signal.

In some embodiments, resonant frequencies are determined by direct calculations such as Discrete Fourier Transforms (DFT). A vibration level can be determined for a single frequency by using DFT. In some embodiments, a digital filter (e.g., a finite impulse response filter) is used to obtain vibration levels for a certain frequency bandwidth.

Vibration levels are stored in a table for given speeds or duty cycles. The vibration levels are compared to a pre-determined threshold to determine if a vibration level corresponds to a resonant frequency. The pre-determined threshold can be determined based on a comparison to known scaling of excitation forces compared to the speed of the fan 105. Thus, a resonant frequency is identified when a vibration level that exceeds an expected response by a pre-determined amount and the speed at which the resonance occurs can be avoided. The table can be continuously updated or can be generated each time the system is started. The data used to update the table can be filtered, weighted, or raw. In addition, multiple tables can be maintained based on various operating conditions (e.g., temperature, humidity, etc.). In some embodiments, these tables can be model-based filters.

In some embodiments, a slope of a vibration level versus RPM or PWM duty cycle is used to identify resonant frequencies, and to determine whether to increase or decrease the speed of the rotating component 105 to avoid a resonant frequency. Referring back to FIG. 2, the graph shows the magnitude of a detected stimulus as the speed of a rotating component 105 is increased. For each time on the x-axis, there is a corresponding speed. In the graph of FIG. 2, the rotating component 105 is operating at resonant frequencies for the speeds associated with the time period between about 44 and about 46 seconds with the peak resonant frequency occurring at the speed associated with about 45 seconds. During the time period of about 44 seconds to about 45 seconds, the slope of the stimulus is significantly positive, while during the time period of about 45 seconds to about 46 seconds, the slope of the stimulus is negative. If the rotating component 105 is operating at a speed associated with the significantly positive slope (i.e., the time period of about 44 seconds to about 45 seconds), the motor controller 115 reduces the speed of the rotating component 105, moving the speed away from the peak resonant frequency. Likewise, if the rotating component 105 is operating at a speed associated with the negative slope (i.e., the time period of about 45 seconds to about 46 seconds), the motor controller 115 increases the speed of the rotating component 105, moving the speed away from the peak resonant frequency.

In some embodiments, lower resonant fan speeds result in noise, vibration, and wear that are deemed not significant. At these lower speeds, resonant frequencies are ignored and the fan 105 is allowed to operate at the resonant frequency.

In addition to noise, vibration, and wear, resonance can cause other psychoacoustic phenomena to occur. One such phenomenon is "beating" which can occur when the fan's speed is at or near the RPM or firing rate of the engine. Beating may also occur when critical fan orders are near a critical order of other rotating components. In some embodiments, beating is avoided by the motor controller 115 receiving a signal from the engine controller 120 indicative of the RPM of the engine. The motor controller 115 then ensures that the speed of the fan 105 does not come within a critical range of the RPM of the engine or a critical harmonic of the engine RPM. Where the speed of the engine is not available or the speed of the fan 105 is not known, signal processing of the sensor 120 signal is used to identify the beating phenomena and adjust the duty cycle of the motor 110 to avoid the frequency of the engine.

Figure 5:
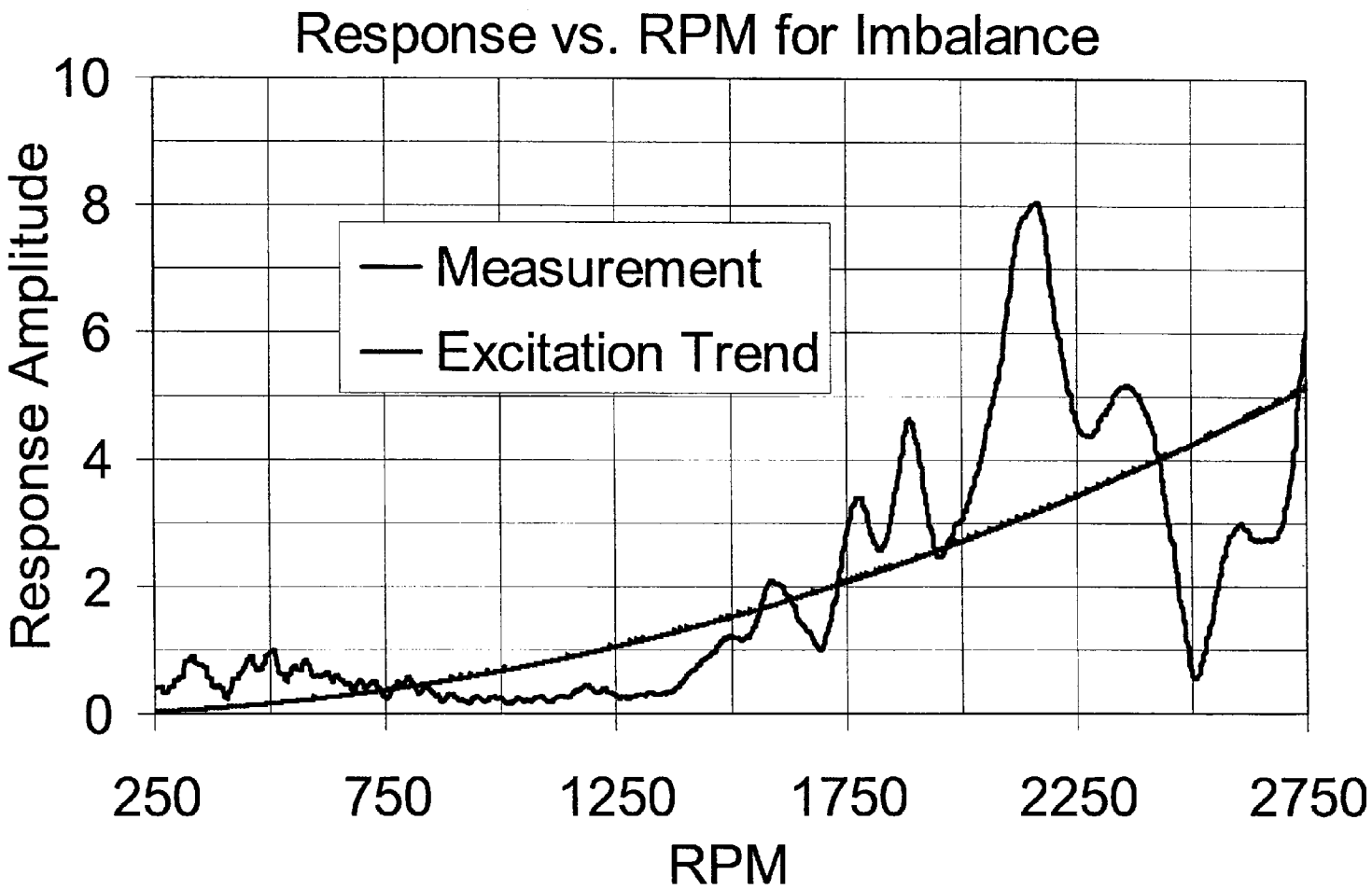
FIG. 5 is a graph of a magnitude of a measured stimulus caused by a rotating component versus a regression curve of an expected trend caused by excitation forces.

Excitation forces, due to imbalance, scale with the square of the speed of the rotating component 105. In some embodiments, a regression curve of the expected excitation forces is calculated. This regression curve is compared to the actual measured response, and when the measured response significantly exceeds the regression curve, the speed of the rotating component 105 is considered to be at a resonant frequency. FIG. 5 shows a regression curve of the expected noise for a fan 105 charted against actual noise detected by a sound pressure sensor. At speeds between about 2000 and 2250 RPM the actual noise exceeds the expected noise. Therefore, these speeds should be avoided. Using the slope of the actual noise curve, the speed of the fan can be adjusted up or down to avoid these frequencies. In some embodiments, the speed of the fan 105 is reduced when the desired speed is between about 2000 and about 2150 RPM (i.e., the slope of the noise curve is significantly positive), and the speed of the fan 105 is increased when the desired speed is between about 2150 and about 2250 (i.e., the slope of the noise curve is negative).

Thus, the invention provides, among other things, systems and methods for determining when a rotating component is exciting resonances and for adjusting the speed of a rotating component to avoid operating the rotating component at resonant frequencies. Various features and advantages of the invention are set forth in the following claims.

What is claimed is:

1. A system comprising:

a rotating component;

a motor driving the rotating component;

a sensor detecting a value of at least one of noise and vibration generated at least in part by the rotating component; and a controller including a memory, the memory storing a value of noise for each of a plurality of operating speeds of the rotating component, the controller receiving the detected value of noise from the sensor and comparing the detected value of noise to the stored value of noise for the plurality of operating speeds to determine if the rotating component is operating at a resonant frequency, the controller adjusting a speed of the motor when the controller determines the rotating component is operating at a resonant frequency, wherein the controller generates the stored value of noise for each of the plurality of operating speeds by increasing a speed of the rotating component from zero to a test operating speed while receiving detected values of noise from the sensor, and storing the value of noise received from the sensor when the speed of the rotating component reaches one of the plurality of operating speeds.

2. The system of claim 1, wherein the controller filters the detected value of noise using at least one selected from the group comprising a low-pass filter, a band-pass filter, a high-pass filter, and a digital filter.

3. The system of claim 1, wherein the controller compares the detected value of noise to a stored value of noise for at least one of the plurality of operating speeds, the controller determining that the rotating component is operating at a resonant frequency when the detected value of noise exceeds the stored magnitude plus a predetermined threshold value.

4. The system of claim 3, wherein the predetermined threshold value varies based on an environmental condition.

5. The system of claim 4, wherein the environmental condition includes at least one selected from the group comprising temperature and humidity.

6. The system of claim 1, wherein the controller adjusts the speed of the rotating component higher when the rotating component is determined to be operating at a resonant frequency and a slope of the stored values of noise is negative for an operating speed of the rotating component.

7. The system of claim 1, wherein the controller adjusts the speed of the rotating component lower when the rotating component is determined to be operating at a resonant frequency and a slope of the stored values of noise is positive for an operating speed of the rotating component.

8. The system of claim 1, wherein the stored values of noise include a regression curve of expected value levels, the controller determining that the rotating component is operating at a resonant frequency when at least one of the detected value of noise and the rate of change of the detected value of noise is greater than a predetermined value.

9. A vehicle comprising:

a control module;

an engine cooling fan;

a motor driving the engine cooling fan;

a sensor detecting a value of at least one of noise and vibration generated at least in part by the engine cooling fan; and a motor controller coupled to the control module and controlling the motor to rotate the engine cooling fan based on an indication from the control module, the motor controller receiving an indication of the magnitude of the value from the sensor and adjusting a speed of the engine cooling fan when the value indicates the engine cooling fan is exciting a resonant frequency, wherein the motor controller determines that the rotating component is operating at a resonant frequency when the magnitude of the value exceed a stored magnitude plus a predetermined threshold value, wherein the predetermined threshold value varies based on an environmental condition, and wherein the motor controller generates the stored magnitude for each of a plurality of operating speeds by increasing a speed of the rotating component from zero to a test operating speed while receiving detected magnitudes of the value from the sensor, and storing the magnitude of the value received from the sensor when the speed of the rotating component reaches one of the plurality of operating speeds.

10. The vehicle of claim 9, wherein the motor controller compares the indication of the magnitude of the value to a regression curve based on expected excitation forces, the motor controller determining that the engine cooling fan is operating at a resonant frequency when the magnitude of the value is greater than an expected response level.

11. The vehicle of claim 9, wherein the motor controller increases the speed of the engine cooling fan when a slope of the recorded magnitude of the value is negative at an operating speed of the engine cooling fan, and decreases the speed of the engine cooling fan when the slope of the recorded magnitude of the value is positive at the operating speed of the engine cooling fan.

12. The vehicle of claim 9, wherein the motor controller receives an indication of the operating speed of an engine of the vehicle from the controller, the motor controller adjusting the speed of the engine cooling fan when the speed of the engine cooling fan is near a critical harmonic of the operating speed of the engine.

13. The vehicle of claim 9, wherein the motor controller determines an operating speed of an engine of the vehicle through signal processing of the detected value, the motor controller adjusting the speed of the engine cooling fan when the speed of the engine cooling fan is near a critical harmonic of the operating speed of the engine.

* * * * *